United States Patent [19]

Suzuki

[11] Patent Number: 4,489,359

[45] Date of Patent: Dec. 18, 1984

[54] CARD KEY SWITCH

[75] Inventor: Masaru Suzuki, Chiryu, Japan

[73] Assignee: Kabushiki Kaisha Tokai Rika Denki Seisakusho, Aichi, Japan

[21] Appl. No.: 461,244

[22] Filed: Jan. 26, 1983

[30] Foreign Application Priority Data

Jan. 28, 1982 [JP] Japan ..... 57-12061

[51] Int. Cl.[3] ..... E05B 49/00

[52] U.S. Cl. ..... 361/172; 70/277; 361/175

[58] Field of Search ..... 361/171, 172, 173, 175; 70/277, 278; 340/825.31, 825.32; 307/10 AT; 250/555, 566, 569

[56] References Cited

U.S. PATENT DOCUMENTS

| | | | |
|---|---|---|---|
| 3,550,410 | 12/1970 | Toepfer | 70/364 |
| 3,749,930 | 7/1973 | Roe | 361/172 X |
| 3,764,859 | 10/1973 | Wood et al. | 361/172 |
| 3,781,805 | 12/1973 | O'Neal, Jr. | 340/149 R |
| 3,863,115 | 1/1975 | Hasenbein | 361/175 |

*Primary Examiner*—Harry E. Moose, Jr.
*Attorney, Agent, or Firm*—Jackson, Jones & Price

[57] ABSTRACT

A card key switch including a card key obtained by forming notches, in accordance with a key code, on opposite side edges of a card or a card casing for accommodating the card, a key cylinder formed with a key slot, a plurality of tumblers, a light emitting element and a photo detector operatively associated with the light emitting element so as to generate an electric signal in response to detection of light from the light emitting element.

13 Claims, 6 Drawing Figures

CARD KEY SWITCH

BACKGROUND OF THE INVENTION

The present invention generally relates to a switch and more particularly, to a card key switch in which a card such as a driving license card, etc. or a card casing for accommodating the card therein is used as a key for actuating the card key switch.

Conventionally, there have been employed key switches provided with a locking function in order to prevent persons other than fully authorized persons having specific keys from effecting operational control of motor vehicles, apparatuses, electrical circuits, etc.

For example, there has been proposed a key switch K of this kind including a rotor 1, pin tumblers 2, a lock casing 3, a key 4, switches 5 disposed laterally of the lock casing 3, one for each of the pin tumblers 2, a main switch 6, and pin holes 7 formed in a radial direction of the lock casing 3, for receiving the pin tumblers 2 therein, respectively as shown in FIG. 1. In the key switch K, it is so arranged that the rotor 1 is locked with respect to the lock casing 3 by the pin tumblers 2 movable in the radial direction of the lock casing 3 and the pin tumblers 2 are displaced to an unlocked position of the rotor 1 upon insertion of the key 4 into the rotor 1. The main switch 6 is adapted to be opened or closed when the rotor 1 is rotated by the use of the key 4. Furthermore, in the key switch K, it is so arranged that the switches 5 are opened or closed by the respective pin tumblers 2 which have been displaced, in the pin holes 7 confronting the respective switches 5, to the unlocked position of the rotor 1 upon insertion of the key 4 into the rotor 1.

However, the known key switches of the above described type generally have such inconveniences that, since the key 4 is relatively small in size, it is not so easy to keep it when not in use and further, the key 4 is likely to be readily lost.

Another prior art can be seen in the U.S. Pat. No. 3,764,859.

In this prior art, each pin tumbler set 18' is provided with an emitter 60' and a photo detector 62' Therefore, there is an inconvenience that in a plurality of emitters and photo detectors are necessary.

SUMMARY OF THE INVENTION

Accordingly, an essential object of the present invention is to provide an improved card key switch in which a card such as a driving license card, etc. or a card casing for accommodating the card therein, each having notches formed on opposite side edges thereof in accordance with a key code, **10*b*** is used as a key, the key can be easily kept in custody when not in use and is not likely to be readily lost and further, an electric signal for actuating the card key switch is generated by the use of the card or the card casing, with substantial elimination of the disadvantages inherent in conventional card key switches of this kind.

Another important object of the present invention is to provide an improved card key switch of the above described type which is simple in structure, highly reliable in actual use, suitable for mass production at low cost and can be readily incorporated into motor vehicles and the like at low cost.

In accomplishing these and other objects according to one preferred embodiment of the present invention, there is provided an improved card key switch comprising: a card key which utilizes a card such as a driving license card, etc. or a card casing for accommodating said card therein, each having notches formed on opposite side edges thereof in accordance with a key code; a key cylinder which is formed with a key slot for receiving said card key therein; a plurality of tumblers which are provided at opposite sides of the key slot so as to be movable in a direction at right angles to a direction of insertion of said card key into the key slot such that some of the plurality of said tumblers are projected into the key slot through engagement with the notches of said card casing, respectively and the others of the plurality of said tumblers are retracted from the key slot by said card key in accordance with said key code upon insertion of said card key into the key slot; the plurality of said tumblers each formed with a through-hole extending in the direction of insertion of said card key into the key slot; a light emitting element; and a photo detector which is operatively associated with said light emitting element so as to generate an electric signal in response to detection of light from said light emitting element.

In accordance with the present invention, since the card such as a driving license card, etc. or the card casing therefor is used as the key, the key can be easily kept when not in use and is not likely to be readily lost.

BRIEF DESCRIPTION OF THE DRAWINGS

These and other objects and features of the present invention will become apparent from the following description taken in conjunction with the preferred embodiment thereof with reference to the accompanying drawings, in which.

Figure 1:
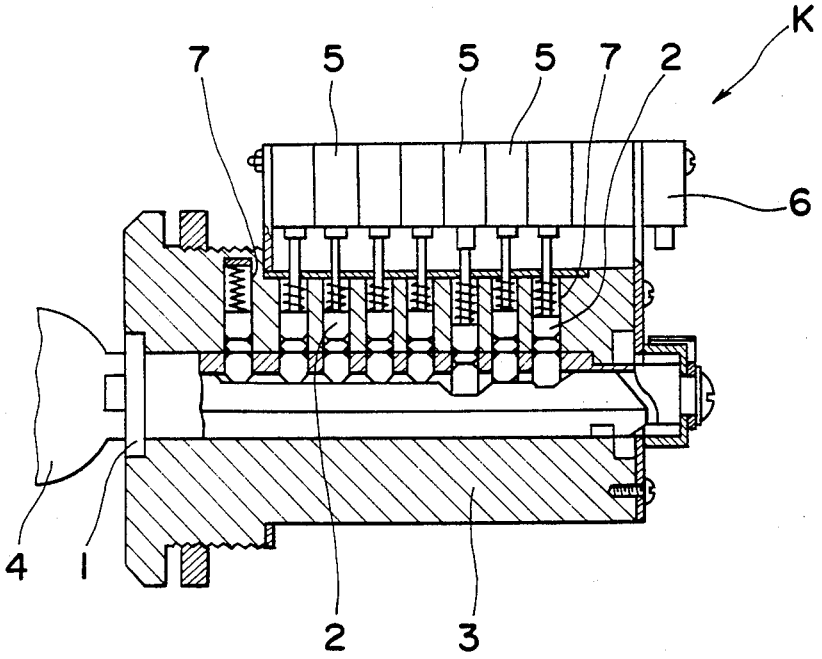
Fig. 1 PRIOR ART
FIG. 1 is a cross-sectional view of a conventional key switch.
Figure 2:
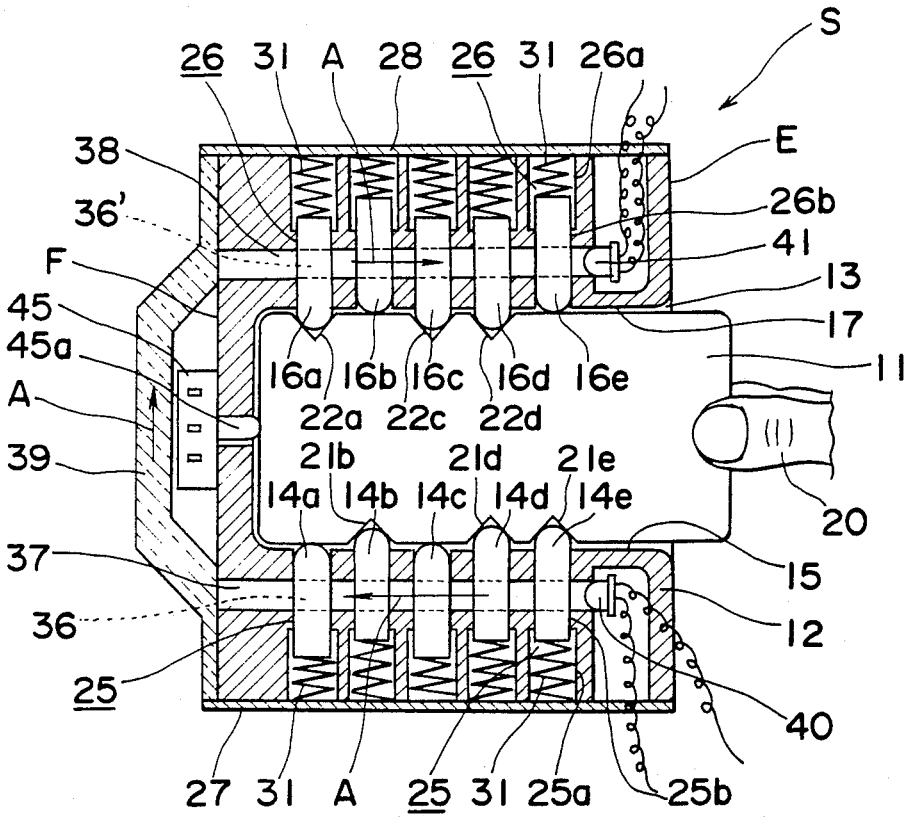
FIG. 2 is a cross-sectional view of a card key switch according to one preferred embodiment of the present invention, FIGS. 3 (*a*) and 3(*b*) are front elevational views of card keys employed in the card key switch of FIG. 2.

Before the description of the present invention proceeds, it is to be noted that like parts are designated by like reference numerals throughout several views of the accompanying drawings. DETAILED DESCRIPTION OF THE INVENTION Referring now to the drawings, there is shown in FIG. 2, a card key switch S of the present invention, which is applied to a key switch of a motor vehicle. The card key switch S includes a card key 11, a key cylinder or lock body 12 having one end E and the other end F with a key slot 13 for receiving the card key 11 therein being formed on the one end E, a series of first tumblers **14*a*, 14*b*, 14*c*, 14*d* and 14*e*, a series of second tumblers 16*a*, 16*b*, 16*c*, 16*d* and 16*e* and compression coiled springs 31, one for each of the first tumblers 14*a* to 14*e* and the second tumblers 16*a* to 16*e***.

It is to be noted here that all directional indications such as "upper", "lower", etc. relate to the illustration in FIG. 2 unless otherwise specified.

The key cylinder 12 further has a series of first stepped holes 25 formed at a lower side of the key slot 13 and extending in the radial direction of the key cylinder 12 and a series of second stepped holes 26 formed at an upper side of the key slot 13 and extending in the radial direction of the key cylinder 12. Each of the first stepped holes 25 includes a spring hole 25*a* and a tumbler hole 25*b* communicating with the key slot 13 at a lower face 15 of the key slot 13 with the spring hole 25*a* being formed larger, in diameter, than the tumbler hole 25*b*. The first tumblers 14*a* to 14*e* are fitted into the tumbler holes 25*b*, respectively so as to be movable upward and downward. After the compression coiled springs 31 are, respectively, disposed in the spring holes 25*a*, a first cover 27 is secured to a lower side face of the key cylinder 12 so as to support the compression coiled springs 31 such that the first tumblers 14*a* to 14*e* are urged upward into the key slot 13 by the compression coiled springs 31. Likewise, each of the second stepped holes 26 includes a spring hole 26*a* and a tumbler hole 26*b* communicatng with the key slot 13 at an upper face 17 of the key slot 13. The second tumblers 16*a* to 16*e* are, respectively fitted into the tumbler holes 26*b* so as to be movable upward and downward. After the compression coiled springs 31 are, respectively, provided in the spring holes 26*a*, a second cover 28 is secured to an upper side face of the key cylinder 12 so as to support the compression coiled springs 31 such that the second tumblers 16*a* to 16*e* are urged downward into the key slot 13 by the compression coiled springs 31.

Figure 3A:
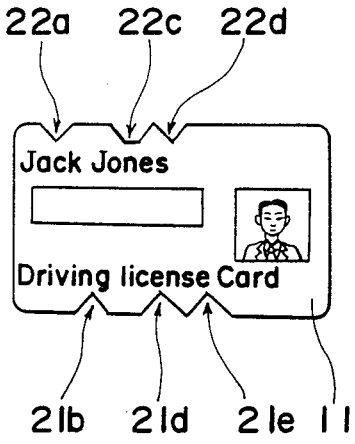
Figure 3B:
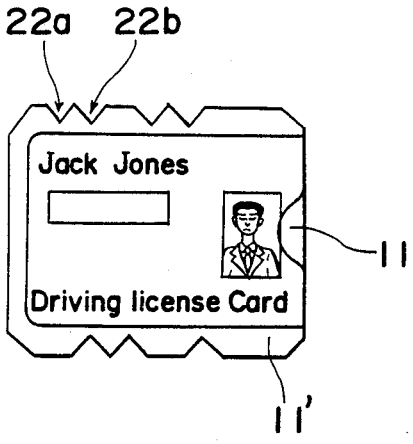

As shown in FIG. 3 (*a*), the card key 11 is obtained by forming first notches 21*b*, 21*d* and 21*e* of a substantially V-shaped configuration and second notches 22*a*, 22*c* and 22*d* of a substantially V-shaped configuration on a driving license card. The notches define a subjective locking code for activating the card key switch. The first notches 21*b*, 21*d* and second notches 22*a*, 22*c* and 22*d* are formed on a lower side edge and an upper side edge of the driving license card, respectively such that the first notches 21*b*, 21*d* and 21*e* and the second notches 22*a*, 22*c* and 22*d* are brought into engagement with the.first tumblers 14*b*, 14*d* and 14*e* and the second tumblers 16*a*, 16*c* and 16*d*, respectively when the card key 11 is fully inserted into the key slot 13.

It is to be noted that each of the first tumblers 14*a* to 14*e* and the second tumblers 16*a* to 16*e* is formed into an identical cylindrical shape and has a hemispherical end confronting the card key 11 such that the card key 11 is smoothly fitted into the key slot 13 through sliding contact of the opposite side edges of the card key 11 by the hemispherical ends of the first tumblers 14*a* to 14*e* and the second tumblers 16*a* to 16*e*.

Furthermore, the key cylinder 12 has a first light guiding through-hole 37 and a second light guiding through-hole 38, both extending in an axial direction of the key cylinder 12. The first light guiding through-hole 37 is provided at the lower side of the key slot 13 so as to pass through the tumbler holes 25*b* at right angles thereto. Likewise, the second light guiding through-hole 38 is provided at the upper side of the key slot 13 so as to pass through the tumbler holes 26*b* at right angles thereto. Each of the first tumblers 14*a* to 14*e* is formed with a first through-hole 36 extending in thc radial direction thereof and having a diameter substantially equal to that of the first light guiding through-hole 37. Similarly, each of the second tumblers 16*a* to 16*e* is formed with a second through-hole 36′ extending in a radial direction thereof and having a diameter substantially equal to that of the second light guiding through-hole 38. It should be noted that the first tumblers 14*a* to 14*e* and the second tumblers 16*a* to 16*e* are, respectively, fitted into the tumbler holes 25*b* and 26*b* such that the first through-holes 36 and the second through-holes 36′ are directed in the axial direction of the key cylinder 12.

Moreover, a light guide 39 of a substantially U-shaped configuration is provided at the other end F of the key cylinder 12 remote from the one end E formed with the key slot 13 such that opposite ends of the light guide 39 are connected with one end of the first light guiding through-hole 37 and one end of the second light guiding through-hole 38, respectively. The light guide 39 is made of glass or transparent synthetic resin. Meanwhile, a light emitting element 40 and a photo detector 41 such as a photo diode, etc. are, respectively, provided at the other end of the first light guiding through-hole 37 and at the other end of the second light guiding through-hole 38, i.e. adjacent to the one end E of the key cylinder 12. Moreover, a microswitch 45 is provided at the other end F of the key cylinder 12 such that an actuator 45*a* of the microswitch 45 is projected into the key slot 13.

Figure 4:
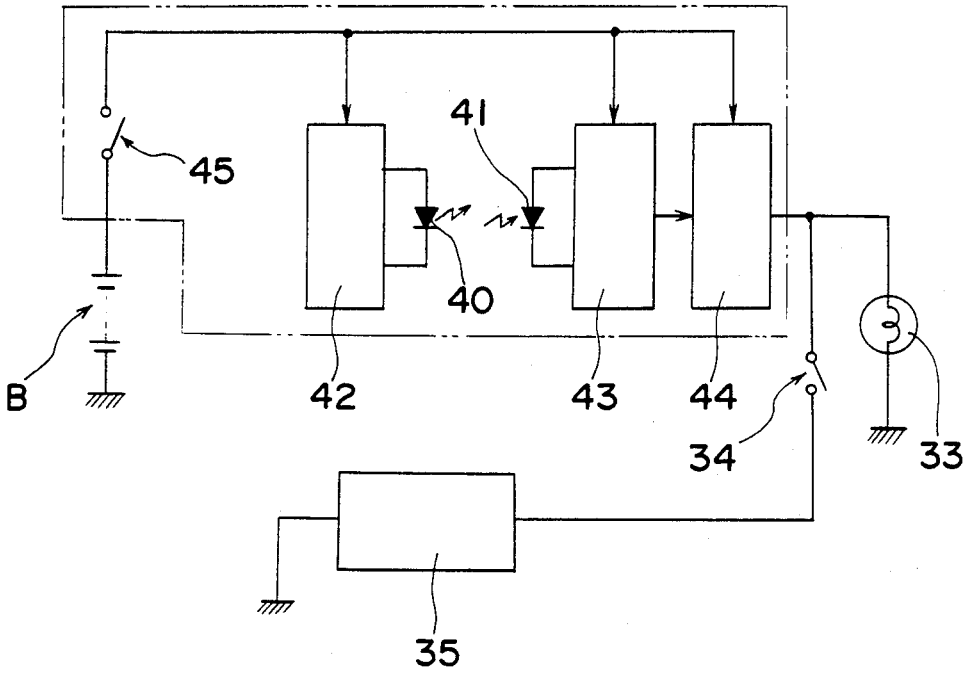
FIG. 4 is an electrical circuit diagram of the card key switch of FIG. 2.

Referring now to FIG. 4, there is shown an electrical circuit of the card key switch S referred to above, including the light emitting element 40, the photo detector 41, a drive circuit 42 for the light emitting element 40, an amplifier 43 for amplifying an output of the photo detector 41, a switching circuit 44, the microswitch 45, a lamp 33, a starting switch 34, a load 35 such as a relay for starting an engine of the motor vehicle or the like, and a battery B. The microswitch 45 is connected in series to the positive terminal of battery B leading to ground, on one hand and is connected to the drive circuit 42, the amplifier 43 and the switching circuit 44, on the other hand. The light emitting element 40 and the photo detector 41 are connected to the drive circuit 42 and the amplifier 43, respectively. Furthermore, the amplifier 43 is connected to the switching circuit 44 which is, in turn, connected to the lamp 33 leading to ground. The starting switch 34 is connected to the junction of the switching circuit 44 and the lamp 33, on one hand and is connected to the load 35 leading to ground, on the other hand. The switching circuit 44 is adapted to be energized so as to supply electric power to the lamp 33 and the load 35 when an output of the amplifier 43 exceeds a predetermined potential level. Meanwhile, it is so arranged that the microswitch 45 is actuated through depression of the actuator 45*a* by a forward end of the card key 11 upon insertion of the card key 11 into the key slot 13. The drive circuit 42, amplifier 43 and switching circuit 44 are supplied with electric power by the battery B.

In the above described arrangement of the card key switch S, it is so arranged that, when the card key 11 has been fully inserted into the key slot 13 with a rearward end of the card key 11 being gripped by fingers 20 of an operator as shown in FIG. 2, the first tumblers 14*b*, 14*d* and 14*e* and the second tumblers 16*a*, 16*c*, and 16*d* are fitted into the first notches 21*b*, 21*d* and 21*e* and the second notches 22*a*, 22*c* and 22*d*, respectively while the first tumblers 14*a* and 14*c* and the second tumblers 16*b* and 16*e* are pushed downward and upward against an urging force of the compression coiled springs 31, respectively with the microswitch 45 being actuated. The first through-hole 36 of the first tumblers 14*a* to 14*e* and the second through-holes 36′ of the second tumblers 16*a* to 16*e* are aligned with the first light guiding through-hole 37 and the second light guiding through-hole 38, respectively, so that the first light guiding through-hole 37 confronting the light emitting element 40 is communicated, through the light guide 39, with the second light guiding through-hole 38 confronting the photo detector 41 and thus, light emitted from the light emitting element 40 reaches the photo detector 41 in the direction of the arrow A in FIG. 2 through the first light guiding through-hole 37, light guide 39 and second light guiding through-hole 38. When the light emitted from the light emitting element 40 reaches the photo detector 41 as described above, the output of the photo detector 41 is amplified by the amplifier 43, so that the switching circuit 44 is energized by the output of the amplifier 43 and thus, the lamp 33 is turned on so as to indicate, for example, that it is possible to start the engine of the motor vehicle. When the starting switch 34 is turned on in this state, the load 35 such as the relay for starting the engine of the motor vehicle or the like is supplied with electric power by the battery B and thus, the engine or the like is started.

Meanwhile, the card key 11 obtained from the driving license card shown in FIG. 3 (*a*) can be replaced by a card key 11′ which is obtained by forming second notches 22*a*, 22*b*, etc. on opposite side edges of a card casing for accommodating the driving license card therein as shown in FIG. 3 (*b*).

Furthermore, the microswitch 45 can be replaced by a contact made of pressure-sensitive rubber, used as a pressure-sensitive switch, or a lever switch.

Moreover, it is needless to say that the number of the tumblers can be changed to any proper value as required and therefore, is not limited to that of the foregoing embodiment of the present invention.

Figure 5:
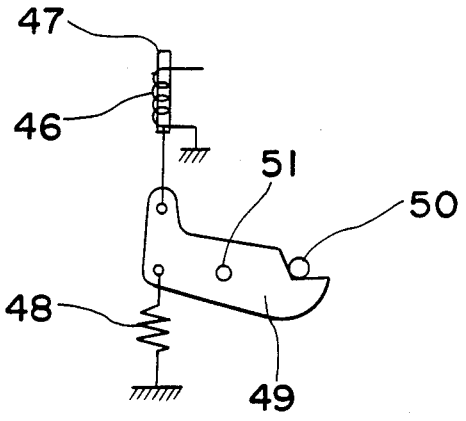
FIG. 5 is a schematic illustration explanatory of an unlocking device to which the card key switch of the present invention may be applied.

In addition to the key switch of the motor vehicle, the card key switch of the present invention can be also applied to an unlocking device including a solenoid 46 provided with a plunger 47, a tension spring 48, a lever 49 and a locking pin 50 as shown in FIG. 5. In the unlocking device, the solenoid 46 acts as the load 35 of the card key switch S and the lever 49 is urged at all times in the counterclockwise direction in FIG. 5 by the spring 48 such that the lever 49 is held in engagement with the locking pin 50. It is so arranged that the lever 49 is pivoted on a pivot 51 in the clockwise direction in FIG. 5 by the plunger 47 of the solenoid 46 such that the lever 49 is disengaged from the locking pin 50.

As is clear from the foregoing description, in accordance with the present invention, since the card such as a driving license card or the like, or the card casing for accommodating the card therein which is required to be kept without fail when driving the motor vehicle, etc. is used as the key, conventional keys small in size, which have been troublesome to keep when not in use are not required for driving motor vehicles and operating various apparatuses, etc. and further, the key can be easily kept when not in use and is not likely to be readily lost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A card key switch comprising:

a card key which utilizes a card such as a driving license card, etc. or a card casing for accommodating said card therein having notches formed on opposite side edges thereof in accordance with a key code;

a key cylinder which is formed with a key slot for receiving said card key therein;

a plurality of tumblers which are provided at opposite sides of the key slot so as to be movable in a direction at right angles to a direction of insertion of said card key into the key slot such that some of the plurality of said tumblers are projected into the key slot through engagement with the notches of said card key respectively and the others of the plurality of said tumblers are retracted from the key slot by said card key in accordance with said key code upon insertion of said card key into the key slot;

the plurality of said tumblers each formed with a through-hole extending in the direction of insertion of said card key into the key slot;

a light emitting element; and a photo detector which is operatively associated with said light emitting element so as to generate an electric signal in response to detection of light from said light emitting element through the tumbler holes.

2. A card key switch as claimed in claim 1, further including;

a switching circuit which is energized by the electric signal from said photo detector; and a light guide having a first end portion and a second end portion;

said key cylinder being formed with a first light guiding through-hole and a second light guiding through-hole which extend in the direction of insertion of said card key into the key slot at the opposite sides of the key slot, respectively such that the first light guiding through-hole and the second light guiding through-hole are aligned with the corresponding through-holes of the plurality of said tumblers upon insertion of said card key into the key slot;

the first light guiding through-hole confronting said light emitting element at one end of the first light guiding through-hole and being connected to the first end portion of said light guide at the other end of the first light guiding through-hole, and the second light guiding through-hole confronting said photo detector at one end of the second light guiding through-hole and being connected to the second end portion of said light guide at the other end of the second light guiding through-hole, whereby a light path is established between said light emitting element and said photo detector through the first light guiding through-hole, said light guide, the second light guiding through-hole and the through-holes of the plurality of said tumblers upon insertion of said card key into the key slot.

3. A card key switch as claimed in claim 2, further including a plurality of springs, one for each of the plurality of said tumblers, which urge the plurality of said tumblers toward the key slot.

4. A card key switch as claimed in claim 2, wherein said light guide is made of any transparent material such as glass or synthetic resin.

5. An improved electronic lock device comprising:

key means for defining a specific locking code;

a lock body having a key slot for receiving the key means and a plurality of tumbler holes;

a plurality of elongated tumbler members mounted respectively in the tumbler holes for operative movement relative to the key slot, the tumbler members responsive to the specific locking code of the key means, each of the tumbler members having an aperture extending therethrough, the aperture on more than one tumbler member being positioned at different positions along the length of the tumbler member and complementarily to the specific locking code, the lock body further providing an aperture extending through the lock body and interconnecting the tumbler holes when aligned pursuant to the locking code, the tumbler holes are positioned on opposite sides of the key slot;

a light guide member for extending from one side to the other side of the key slot and interconnecting the path of the tumbler apertures;

a source of electromagnetic radiation operatively positioned relatively to the lock body and capable of being guided through the lock body aperture, and detector means operatively positioned relative to the lock body for producing a signal representative of any contact with the electromagnetic radiation, whereby the key means is capable of positioning the tumbler members such that their respective apertures are aligned with the lock body aperture to permit the electromagnetic radiation to pass through the lock body and the tumbler members and contact the detector means.

6. The invention of claim 5 wherein the key means is a card member.

7. The invention of claim 5 wherein the source of electromagnetic radiation consists of a single light emitting member.

8. The invention of claim 5 wherein a plurality of springs, one for each tumbler hole, urge the plurality of tumber members towards the key slot.

9. The invention of claim 5 further including a microswitch connected to the key slot and activating the detector means when the key means is fully inserted into the key slot.

10. An improved electronic lock device comprising:

key card means for defining a specific code adjacent its edges;

a lock body having a key card slot for receiving the key means and a plurality of tumbler holes;

a plurality of elongated tumbler members mounted respectively in the tumbler holes for operative movement relative to the key card slot, the tumbler members responsive to the specific code of the key card means, each of the tumbler members having an aperture extending therethrough, the aperture on more than one tumbler member being positioned at different positions along the length of the tumbler member and complementarily to the specific code, the lock body further providing an aperture extending through the lock body and interconnecting the tumbler holes the tumbler holes are positioned on opposite sides of the key card slot;

a light guide member for extending from one side to the other side of the key slot and interconnecting the path of the tumbler apertures;

a single source of electromagnetic radiation operatively positioned relatively to the lock body and capable of being guided through the lock body aperture, and a single detector means operatively positioned relative to the lock body for producing a signal representative of any contact with the electromagnetic radiation, whereby the key card means is capable of positioning the tumbler members such that their respective apertures are aligned with the lock body aperture to permit the electromagnetic radiation to pass through the lock body and the tumbler members and contact the detector means.

11. The invention of claim 10 wherein the source of electromagnetic radiation consists of a single light emitting member.

12. The invention of claim 10 wherein a plurality of springs, one for each tumbler hole, urge the plurality of tumber members towards the key card slot.

13. The invention of claim 10 further including a microswitch connected to the key card slot and activating the detector means when the key card means is fully inserted into the key card slot.

* * * * *